US005379332A

United States Patent [19]

Jacobson

[11] Patent Number: 5,379,332

[45] Date of Patent: Jan. 3, 1995

[54] LAUNDERABLE AND REPLACEABLE LEAD BLANKET COVER SYSTEM

[76] Inventor: Earl B. Jacobson, 510 S. Shore Dr., Crystal Lake, Ill. 60014

[21] Appl. No.: 874,800

[22] Filed: Apr. 28, 1992

[51] Int. Cl.[6] ..... G21F 3/00

[52] U.S. Cl. ..... 376/287; 250/515.1; 250/519.1; 252/478; 150/154

[58] Field of Search ..... 376/287, 288, 463; 250/515.1, 516.1, 519.1; 150/154; 252/478; 160/351; 428/68, 99

[56] References Cited

U.S. PATENT DOCUMENTS

| | | | |
|---|---|---|---|
| 1,854,942 | 4/1932 | Lapof | 250/517.1 |
| 4,432,932 | 2/1984 | Jacobson | 376/287 |
| 4,619,852 | 10/1986 | Mio et al. | 250/519.1 |
| 4,771,179 | 9/1988 | Ijiri et al. | 250/519.1 |
| 5,012,114 | 4/1991 | Sisson, Jr. | 250/519.1 |

*Primary Examiner*—Daniel D. Wasil
*Attorney, Agent, or Firm*—Foley & Lardner

[57] ABSTRACT

A launderable lead blanket cover system for rehabilitating contaminated lead blankets and which provides a lead blanket launderable cover. Lead blankets which can be removed from a nuclear facility or which are manufactured directly, include an outer cover which is heat sealed around the periphery to the inner lead blanket. The heat sealed periphery can include a plurality of blanket supporting metal grommets having a uniform predetermined spacing. A contaminated lead blanket which cannot be removed from a nuclear facility, has the contaminated cover removed in the nuclear facility and securing strips are secured to the inner cover. The contaminated lead blanket then is rehabilitated by adding a replaceable cover open on one end and having a heat sealed periphery and metal grommets in the other three sides. The open end with the lead blanket inside is then folded over and sealed, such as with an adhesive and then metal grommets can be secured through the sealed periphery to complete the lead blanket. A replaceable cover lead blanket can also be initially formed, if desired. Utilized with either type of lead blanket embodiment is a launderable and incinerable outer cover. The launderable cover includes two piece securing grommets having the same spacing as the metal grommets. The pieces are snapped together through the metal grommets to secure the launderable cover to the lead blanket and unsnapped to remove the cover for laundering or incineration.

16 Claims, 7 Drawing Sheets

LAUNDERABLE AND REPLACEABLE LEAD BLANKET COVER SYSTEM

BACKGROUND OF THE INVENTION

The invention relates generally to lead blankets and more particularly is directed to a launderable and replaceable lead blanket cover system in which the lead blanket includes or is provided with a launderable cover.

In nuclear facilities, such as power plants, permanent radiation shielding is provided, however, temporary radiation shielding is required for various operations, such as maintenance and repair. Conventional temporary radiation shielding is provided by flexible lead blankets which typically are formed from a woven lead core, covered by and sometimes secured to an outer cover, such as a plastic material. The periphery of the outer cover typically is sewn together and metal grommets generally are mounted in the periphery.

The lead blankets are draped or hung over or against areas in the nuclear facilities which are to be shielded during the repair operations. The lead blankets are secured by cables or hooks which are inserted through the metal grommets to support the lead blankets in the desired location.

Once these lead blankets have been contaminated by radiation they historically were disposed, of such as by burying. Such disposal now is prohibited and the nuclear facilities now are accumulating contaminated lead blankets, which cannot be reused and cannot be disposed of. A further problem is that only certain designated areas of a facility can be utilized for such storage.

It thus would be desirable to be able to rehabilitate and reuse contaminated lead blankets and to provide lead blankets which can be reused with minor rehabilitation and which prevent internal contamination.

SUMMARY OF THE INVENTION

The above and other disadvantages of prior art lead blankets and contaminated lead blankets are overcome in accordance with the present invention by providing a launderable and replaceable lead blanket cover system, which can rehabilitate contaminated lead blankets and which provides a lead blanket launderable cover.

The lead blankets can be formed in two embodiments. Lead blankets which can be removed from the nuclear facility or which are manufactured directly, can include an outer cover which is heat sealed around the periphery to the inner lead blanket. The heat sealed periphery includes a plurality of metal grommets having a uniform predetermined spacing. The metal grommets are utilized to support the lead blankets.

If a contaminated lead blanket cannot be removed from a nuclear facility, then the contaminated cover is removed in the nuclear facility and the inner cover has hook and eye loop strips secured thereto. The contaminated lead blanket then is rehabilitated by adding a replaceable cover open on one end and having a heat sealed periphery, generally with metal grommets in the other three sides. The open end with the lead blanket inside is then folded over and sealed, such as with an adhesive and then metal grommets are secured through the sealed periphery to complete the lead blanket. The blankets also can be manufactured with the removable cover where desired. If the replaceable cover becomes contaminated it can be cut open, removed and replaced.

Utilized with either type of lead blanket embodiment is a launderable outer cover. The launderable cover includes two piece securing grommets having the same spacing as the metal grommets and which are snapped together through the metal grommets to secure the launderable cover to the lead blanket. The launderable outer cover can be removed, laundered and replaced whenever desired. The securing grommets preferably are incinerable along with the launderable outer cover, when the launderable outer cover has become too contaminated to reuse.

DETAILED DESCRIPTION OF THE PREFERRED EMBODIMENT

Figure 1:
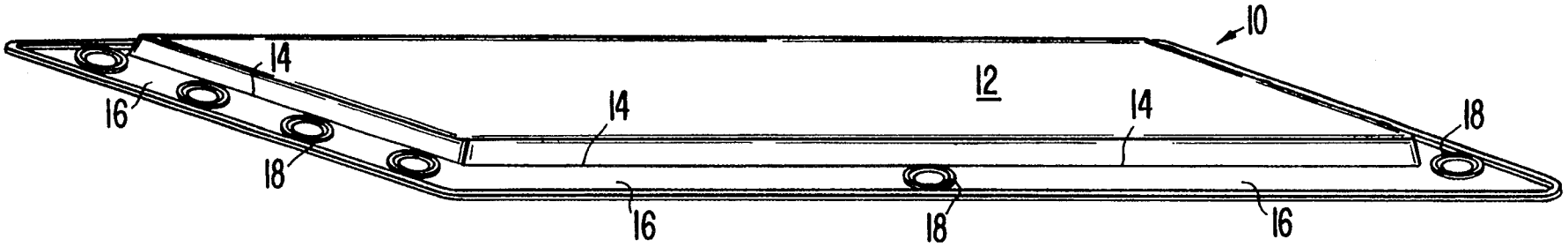
FIG. 1 is a perspective view of a first lead blanket embodiment of the present invention.

Referring to FIG. 1, a first lead blanket embodiment of the present invention is designated generally by the reference numeral 10. The lead blanket includes an inner lead blanket portion (not illustrated), which is enclosed and heat sealed to an outer cover 12. The outer cover 12 is heat sealed to the inner lead blanket along a sealed inner edge 14 of a sealed periphery 16. The outer cover 12 can be formed from a vinyl coated laminate, for example. The vinyl coated laminate is not incinerable, but can be disposed of as solid waste. An incinerable cover material could be utilized, if desired. The lead wool inner blanket generally cannot be disposed of, once contaminated.

The periphery 16 is heat sealed to itself forming a sealed periphery having a width suitable for mounting metal grommets 18 therein, where desired. The metal grommets 18 preferably are conventional brass grommets, having a five-eights inch inner diameter. The metal grommets 18 are modified for use with the launderable outer cover secured grommets, as described in FIGS. 2–9. The metal grommets 18 are modified by expanding the inner diameter to about three-quarter inches to accommodate the securing of the secured grommets therethrough (see FIG. 3). The secured grommets are sized to again form a five-eights inch inner diameter opening through the metal grommets when the secured grommets are secured therethrough.

Figure 2:
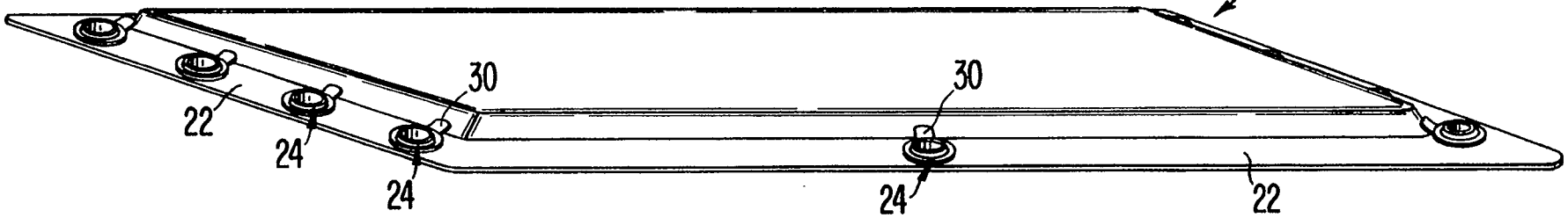
FIG. 2 is a perspective view of a first launderable outer cover embodiment of the present invention.
Figure 3:
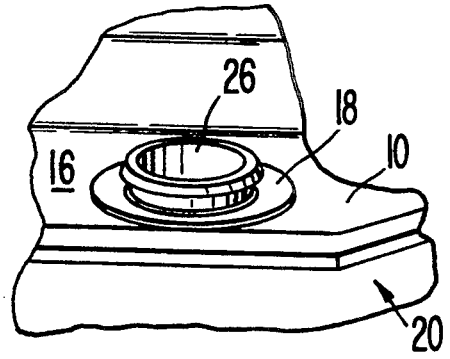
FIG. 3 is perspective view of a first secured grommet embodiment of the present invention.
Figure 4:
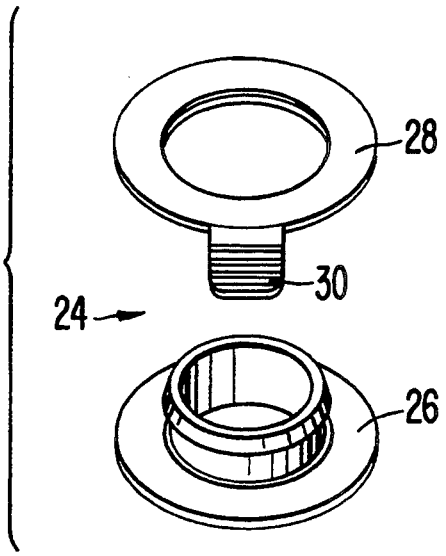
FIG. 4 is an exploded perspective view of the secured grommet of FIG. 3.

Referring to FIGS. 2 and 3, a launderable outer cover embodiment of the present invention is designated generally by the reference numeral 20. The launderable outer cover 20 preferably is formed from a launderable and incinerable material, such as polyurethane coated nylon. The launderable outer cover 20 also includes a periphery 22, which includes a top and a bottom material, each of which includes a mating male or female portion of a securing grommet 24. The launderable outer cover 20 is secured to the lead blanket 10 by snapping the securing grommet 24 through the metal grommet 18.

Referring to FIGS. 2–5, the securing grommet 24 includes a male bayonet type portion 26 over which is snap fit a female portion 28. The female portion 28 includes an optional release tab 30, which can be grasped to pull the launderable outer cover 20 apart when the launderable outer cover 20 is to be laundered or disposed of, such as by incineration. The securing grommet 24 preferably is formed from a water impervious incinerable material, such as polyurethane.

Figure 7:
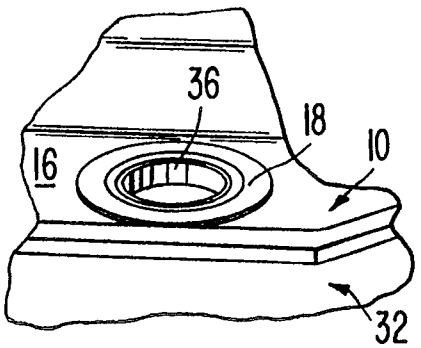
FIG. 7 is a perspective view of a second secured grommet embodiment of the present invention.
Figure 5A:
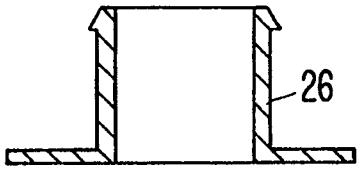
FIGS. 5A and 5B are respective side sectional and top plan views of the male portion of the secured grommet of FIG. 3.
Figure 5B:
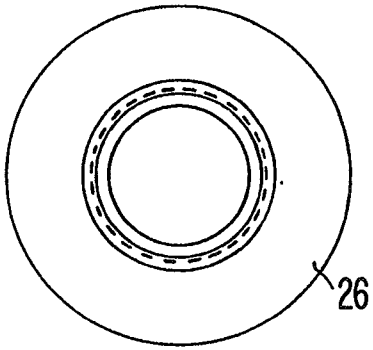
Figure 6:
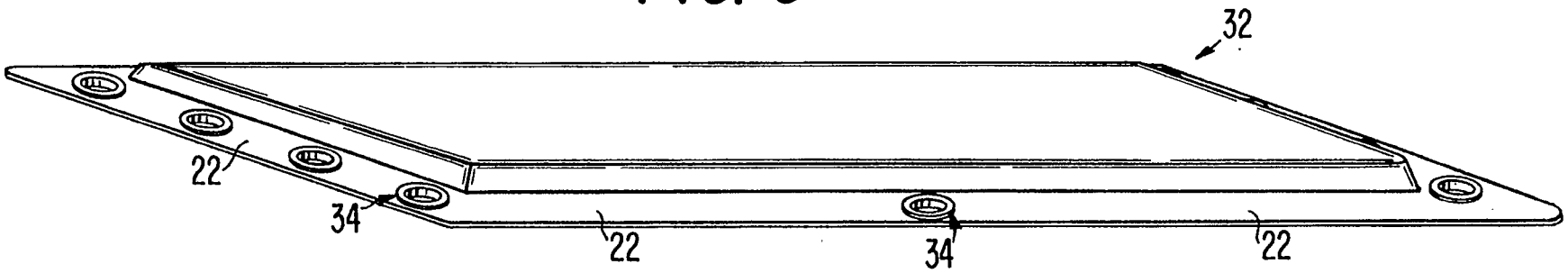
FIG. 6 is a perspective view of a second secured launderable outer cover embodiment of the present invention.
Figure 8A:
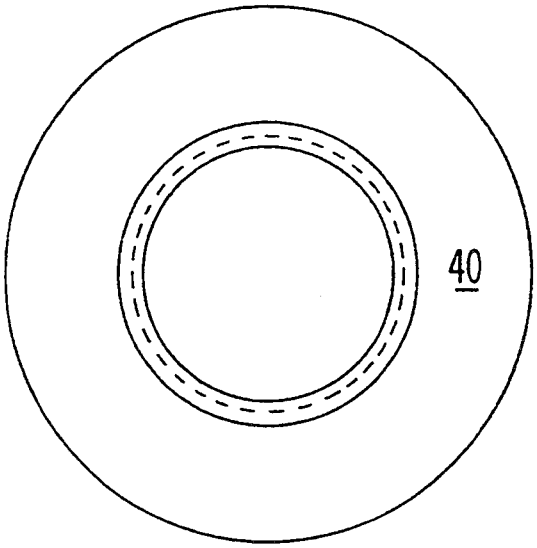
FIGS. 8A and 8B are respective top plan and side sectional views of the female portion of the secured grommet of FIG. 7.
Figure 8B:
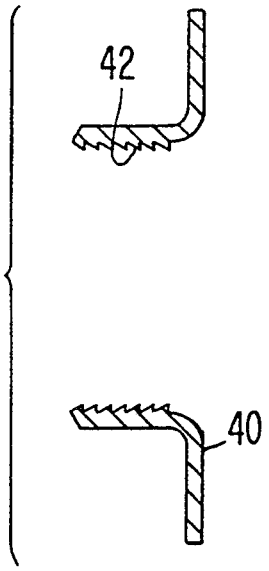
Figure 9A:
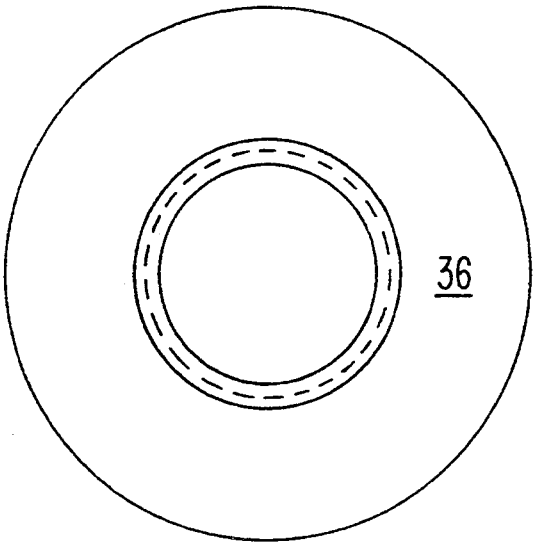
FIGS. 9A and 9B are respective top plan and side sectional views of the male portion of the secured grommet of FIG. 7.
Figure 9B:
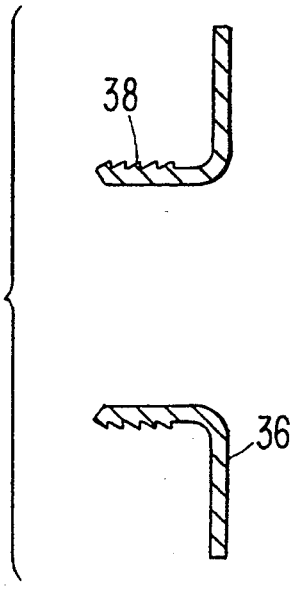

A second launderable outer cover embodiment of the present invention is designated generally by the reference numeral 32, in FIGS. 6 and 7. The launderable outer cover 32 is formed the same as the launderable outer cover 20, with the exception of a different type of securing grommet 34. The securing grommet 34, referring to FIGS. 8 and 9, has a male bayonet portion 36. The male bayonet portion 36 includes one or a plurality of barbs or ridges 38 on the outer periphery thereof. The securing grommet 34 also includes a female bayonet portion 40 having one or more barbs or ridges 42 on the inner periphery thereof and sized to snap fit over the male bayonet portion 36. The material on both sides of the launderable outer cover 32 is grasped to detach the securing grommet 34 to remove the launderable outer cover 32, when desired.

Figure 10:
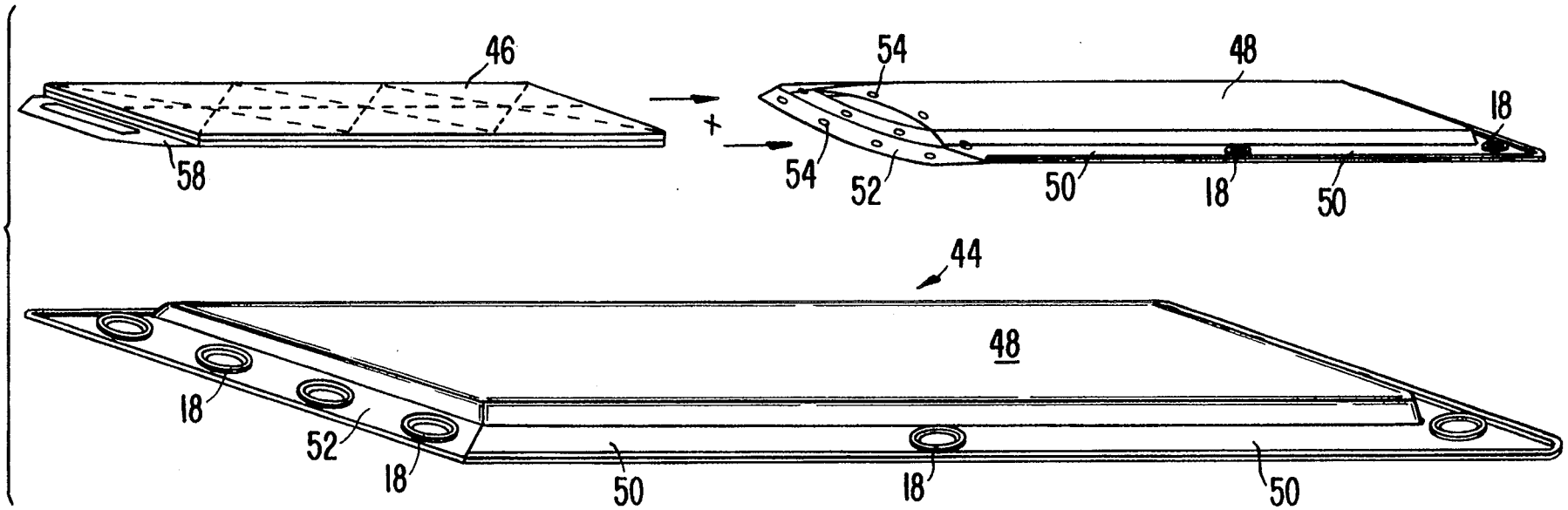
FIG. 10 is an exploded perspective view of a second lead blanket embodiment of the present invention.

A second lead blanket embodiment of the present invention is designated generally by the reference numeral 44, illustrated in FIG. 10. The lead blanket 44 is formed in a nuclear facility when the lead blanket, contaminated or not, cannot be removed from the nuclear facility. In this case, the covering is removed from the present lead blanket in the nuclear facility, leaving a partially covered inner lead blanket portion 46. The blanket portion 46 is inserted into a replaceable outer cover 48, generally like the outer cover 12. The replaceable outer cover 48 includes a heat sealed periphery 50, like the periphery 16, on three sides of the outer cover 48. The periphery 50 also generally includes a plurality of the metal grommets 18 mounted therein. The replaceable outer cover 48 includes an open end 52, having a plurality of grommet mounting holes 54 preformed therein or later formed therein.

The inner blanket portion 46 is inserted into the replaceable cover 48 and the open end 52 is folded upon itself and secured and sealed, such as by adhesive to seal the periphery thereof. The metal grommets 18 then are inserted to complete the lead blanket 44. The lead blanket 44 can be formed without the metal grommets 18 and can include hook and loop securing straps or can just be hung or laid over objects.

The launderable outer cover 20 or 32 can then be utilized over the replaceable cover 48, if desired, when the replaceable cover 48 has been contaminated, such as by not utilizing the launderable outer cover 20 or 32 or if the launderable outer cover 20 or 32 has been ruptured, then the replaceable cover 48 can be replaced and disposed of. The end 52 of the lead blanket 44 is cut off and the lead blanket portion 46 is removed and a new cover 48 is then placed over the lead blanket portion 46, as previously described.

Figure 11:
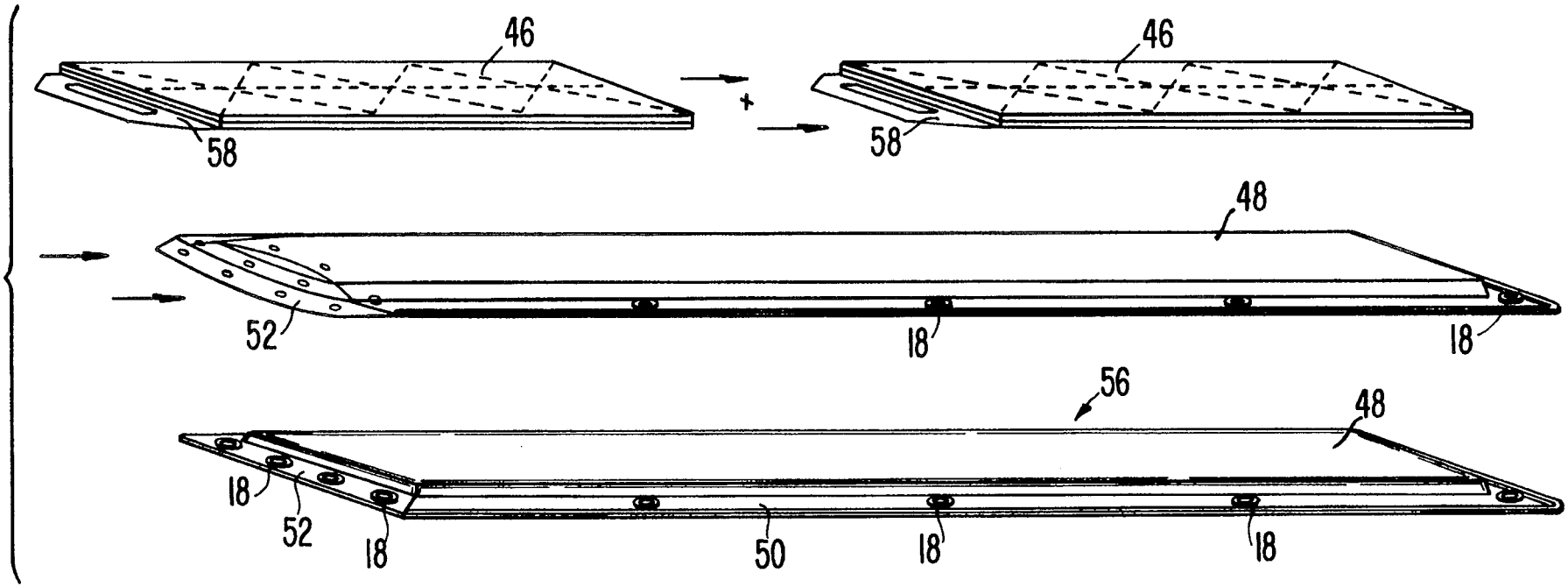
FIG. 11 is an exploded perspective view of a third lead blanket embodiment of the present invention.

A third lead blanket embodiment designated generally by the reference numeral 56, is illustrated in FIG. 11. The lead blanket 56 is substantially identical to the lead blanket 44, except that the replaceable cover 48 is sized to accommodate two inner blanket portions 46. Although two inner lead blanket portions 46 are illustrated, a plurality, such as three or more can be inserted into a single replacement cover 48, as desired. Also illustrated is a spatula 58, which preferably is utilized to insert and remove the inner lead blanket 46 from the replaceable cover 48. The spatula 58 can be plastic or metal, such as stainless steel and is utilized to break the hook and loop fasteners, illustrated in FIGS. 13 and 14.

Figure 12:
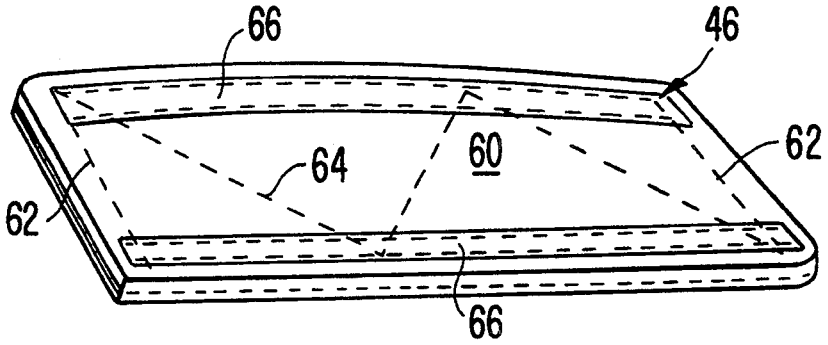
FIG. 12 is a perspective view of an inner lead blanket portion of the lead blanket embodiment of FIG. 10.
Figure 13:
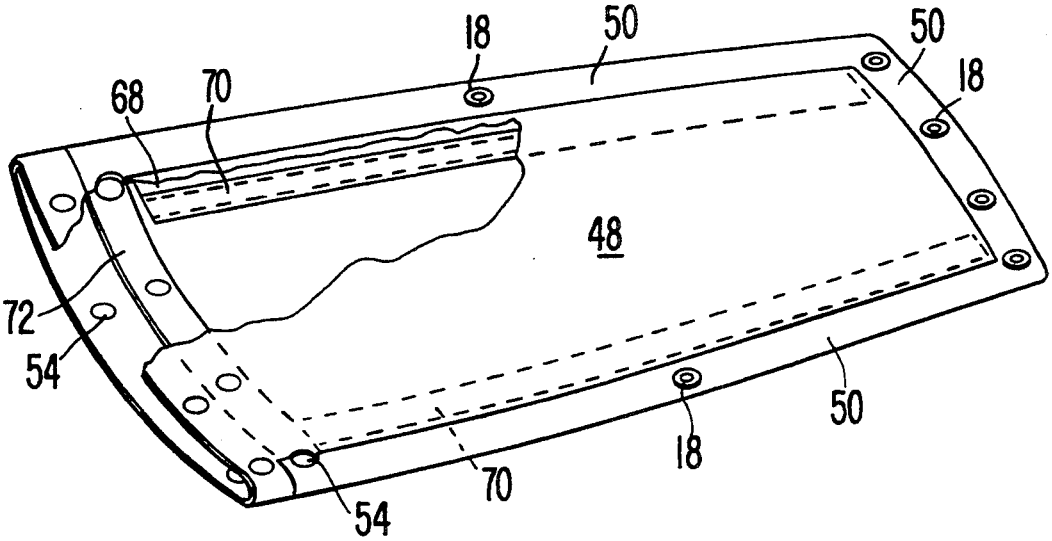
FIG. 13 is a perspective view partially in section of the lead blanket embodiment of FIG. 10.
Figure 14:
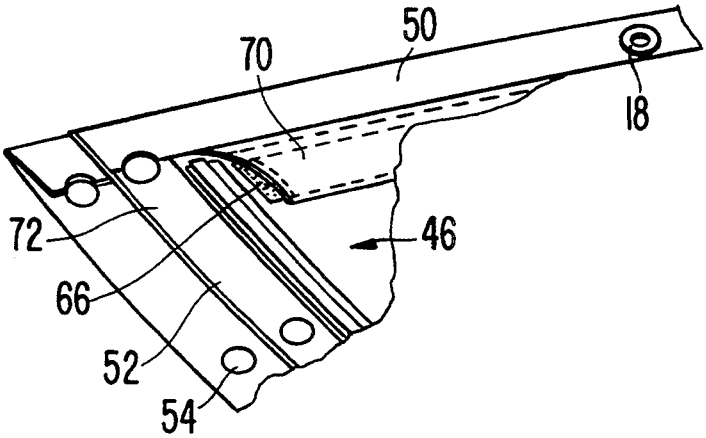
FIG. 14 is an enlarged partial perspective view of the lead blanket of FIG. 10.

The lead blankets 44 or 56 are formed as best illustrated in FIGS. 12–14. The inner lead blanket or billet 46 has a partial or whole cover 60, which has a sew line 62 sealing the ends thereof. The inner lead blanket 46 also includes stitching 64 securing the cover 60 to the inner lead wool or fiber material, so that the lead material does not shift in the inner lead blanket 46.

Two hook and loop type strips 66 are adhered or sewn to the cover 60, prior to insertion into the replaceable outer cover 48. The replaceable outer cover 48 includes an internal flap 68 on both sides of the outer cover 48 (only one of which is illustrated). Each of the flaps 68 includes a mating hook and loop strip 70 which mates with the hook and loop strips 66 when the inner lead blanket 46 is inserted into the replaceable outer cover 48, as illustrated in FIG. 14. The mating of the strips 66 and 70 prevents the inner lead blanket 46 from becoming displaced inside the replaceable outer cover 48. Although the strips 66 and 70 are illustrated as a pair of strips on one side of the blanket, they can be formed on both sides in any number or configuration desired. The open end 52 can be secured to itself utilizing a double sided tape strip 72 adhered or secured thereto.

When the replaceable outer cover 48 is desired to be removed, then the sealed end 52 is cut off or open. The spatula 58 is then inserted between the strips 66 and 70 to release and remove the inner lead blanket 46 from the replaceable outer cover 48. A new replaceable cover 48 then is placed over the inner lead blanket 46.

Many modifications and variations of the present invention are possible in light of the above teachings. The size and shape of the lead blanket can be changed as desired. The hook and loop materials can be any type of synthetic materials which adhere when pressed together, such as sold under the trademark Velcro. The secured grommets preferably are removably snap fit together, however, they also could be non-removably snap fit together where only a single use of the lead cover is contemplated. The metal grommets have been described as modified or expanded to accommodate the secured grommets, but could also be formed in larger sizes. The launderable cover still is useful since it can be scrubbed and prevents contamination of the lead blanket covering under the launderable cover. The launderable outer covers 20 and 32 can be closed on three sides, with the remaining open end folded over upon itself for sealing. Alternately, the open cover end also can be sealed by releasable tape or adhesive, if desired to be reused. It is, therefore, to be understood that within the scope of the appended claims the present invention may be practiced otherwise than as specifically described.

I claim:

1. A lead blanket cover system, comprising:

an inner lead blanket; and an outer cover secured to said inner blanket, said outer cover including a sealed portion on at least three sides of a periphery of said outer cover, said outer cover being separately replaceable.

2. The system as defined in claim 1 including a plurality of metal grommets having a predetermined spacing secured through said sealed periphery of said outer cover.

3. The system as defined in claim 2 including a replaceable cover secured to and covering said outer cover.

4. A lead blanket cover system, comprising:

an inner lead blanket; and an outer cover secured to said inner blanket, said outer cover including a sealed portion on at least three sides of a periphery of said outer cover, said outer cover being separately replaceable, said inner lead blanket having securing strips secured to at least one side thereof and said replaceable outer cover having mating securing strips secured to the inside thereof and mating with said inner lead blanket securing strips.

5. A launderable lead blanket cover system, comprising:

an inner lead blanket;

an outer cover secured to said inner blanket, said outer cover including a sealed portion around a periphery of said outer cover, said periphery being heat sealed on all sides of said outer cover and sealed to a periphery of said inner cover;

a plurality of metal grommets having a predetermined spacing secured through said sealed portion of said periphery of said outer cover; and a replaceable cover secured to and covering said outer cover.

6. The system as defined in claim 5 wherein said replaceable cover is also launderable.

7. A launderable lead blanket cover system, comprising:

an inner lead blanket having securing strips secured to at least one side thereof; and an outer cover having mating securing strips secured to the inside thereof and mating with said inner lead blanket securing strips, and said outer cover having a sealed periphery, and being heat sealed on at least three sides thereof.

8. The system as defined in claim 7, including a plurality of metal grommets having a predetermined spacing secured through said sealed periphery of said outer cover.

9. The system as defined in claim 8 including a launderable cover secured to and covering said outer cover, said launderable cover including a plurality of two-part securing grommets spaced and insertable through at least some of said outer cover metal grommets to secure said launderable cover to said lead blanket outer cover.

10. The system as defined in claim 9, wherein said two-part securing grommets are formed in a removable snap-fit configuration.

11. The system as defined in claim 9, including said launderable cover and said securing grommets being incinerable.

12. The system recited in claim 11 wherein said launderable cover is replaceable.

13. A launderable lead blanket cover system as defined in claim 7, including said outer cover being said sealed on all sides of the periphery, with said sealed portions extending to the periphery of said inner lead blanket, and further comprising a plurality of metal grommets having a predetermined spacing secured through said sealed periphery of said outer cover, a launderable cover secured to and covering said outer cover, and said launderable cover including a plurality of two-part securing grommets spaced and insertable through at least some of said outer cover metal grommets to secure said launderable cover to said lead blanket outer cover.

14. The system defined in claim 13 wherein said two part securing grommets are formed in a removeable snap fit configuration.

15. The system as defined in claim 13 including said replaceable cover and said securing grommets being incinerable.

16. The system as defined in claim 13 wherein said launderable cover is replaceable.

* * * * *